US008807792B2

(12) United States Patent
Cho et al.

(10) Patent No.: US 8,807,792 B2
(45) Date of Patent: Aug. 19, 2014

(54) LIGHTING APPARATUS

(75) Inventors: Hankyu Cho, Seoul (KR); Jaehwan Kim, Seoul (KR); Dongki Paik, Seoul (KR)

(73) Assignee: LG Electronics Inc., Seoul (KR)

( * ) Notice: Subject to any disclaimer, the term of this patent is extended or adjusted under 35 U.S.C. 154(b) by 87 days.

(21) Appl. No.: 13/465,117

(22) Filed: May 7, 2012

(65) Prior Publication Data

US 2013/0039056 A1 Feb. 14, 2013

(30) Foreign Application Priority Data

Aug. 12, 2011 (KR) ..... 10-2011-0080687

(51) Int. Cl.
*F21V 7/00* (2006.01)

(52) U.S. Cl.
USPC ..... 362/247; 362/235; 362/241; 362/646

(58) Field of Classification Search
USPC ..... 362/235, 241, 247, 294, 298, 373, 640, 362/646
See application file for complete search history.

(56) References Cited

U.S. PATENT DOCUMENTS

| | | | | |
|---|---|---|---|---|
| 8,047,685 | B2 * | 11/2011 | Wu et al. | 362/277 |
| 8,157,422 | B2 * | 4/2012 | Paik et al. | 362/294 |
| 8,272,762 | B2 * | 9/2012 | Maxik et al. | 362/249.02 |
| 8,297,797 | B2 * | 10/2012 | Kim et al. | 362/294 |
| 8,303,137 | B2 * | 11/2012 | Paik et al. | 362/294 |
| 8,317,364 | B2 * | 11/2012 | Kim et al. | 362/241 |
| 8,427,037 | B2 * | 4/2013 | Liang et al. | 313/113 |

FOREIGN PATENT DOCUMENTS

| | | |
|---|---|---|
| KR | 10-0565771 B1 | 3/2006 |
| KR | 10-0919177 | 9/2009 |
| KR | 10-2010-0119513 | 11/2010 |
| KR | 10-2011-0006419 A | 1/2011 |

* cited by examiner

*Primary Examiner* — John A Ward
(74) *Attorney, Agent, or Firm* — KED & Associates, LLP

(57) ABSTRACT

A lighting apparatus is disclosed. The disclosed lighting apparatus omni-directionally radiates light emitted from a light emitting diode (LED) in a uniform light intensity. The lighting apparatus may include at least one LED and a reflector to reflect light emitted from the at least one LED. The reflector may include openings that are positioned to correspond to a position of a respective LED. The LED may emit light in a first direction and the reflector may reflect the light in a second direction such that a difference in light intensity at any angle within a first range between 0° to 135° with respect to the first direction is less than or equal 20% of an average light intensity of the entire range, and a light flux within a second range between 135° to 180° is greater than or equal to 5% of the total flux.

19 Claims, 8 Drawing Sheets

LIGHTING APPARATUS

CROSS-REFERENCE TO RELATED APPLICATION(S)

This application claims priority under 35 U.S.C. §119 to Korean Application No. 10-2011-0080687 filed in Korea on Aug. 12, 2011, whose entire disclosure(s) is/are hereby incorporated by reference.

BACKGROUND

1. Field

A lighting apparatus is disclosed herein.

2. Background

Lighting apparatuses are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
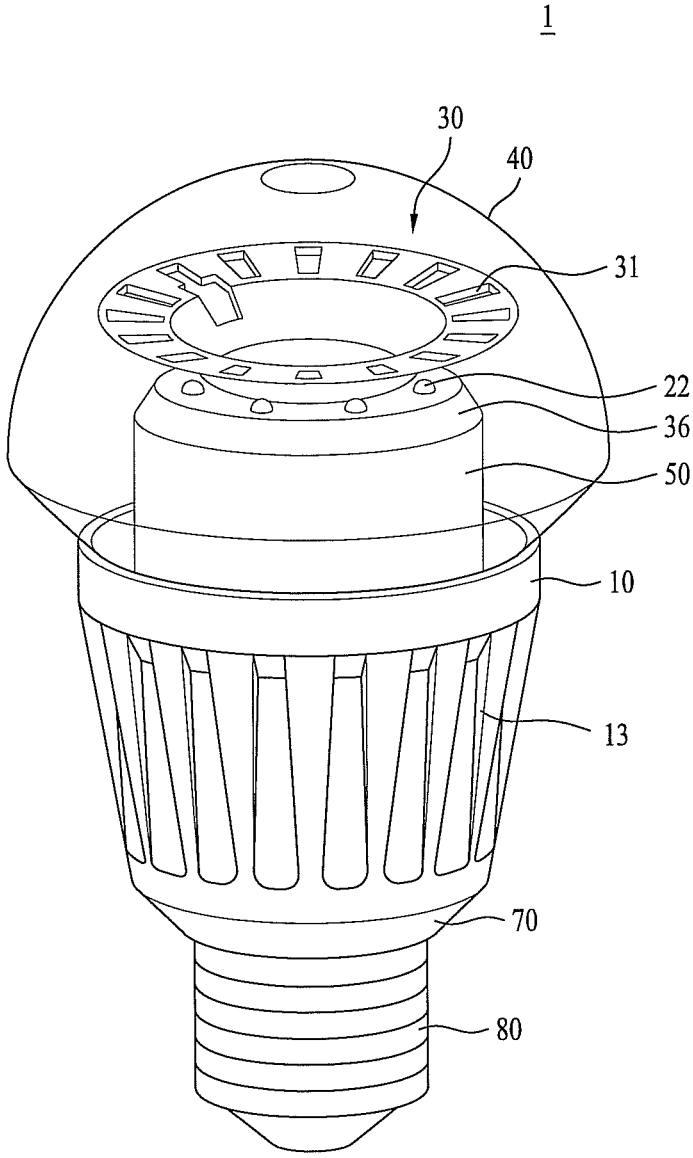
FIG. 1 is a perspective view of a lighting apparatus according to an embodiment of the present disclosure.

Lighting apparatuses may include incandescent bulbs, fluorescent lamps and discharge lamps. These lighting apparatuses may be used for a variety of purposes, such as domestic, industrial, and outdoor purposes. However, lighting apparatuses operating based upon electrical resistance, such as incandescent bulbs, etc., have problems of low efficiency and high heat loss. Discharge lamps are expensive and exhibit relatively poor energy efficiency and fluorescent lamps may be harmful to the environment due to use of mercury.

In contrast, lighting apparatuses which use light emitting diodes (LEDs) may avoid these disadvantages while providing many benefits, such as higher efficiency as well as flexibility in the design of the lighting apparatus (e.g., colors and designs). An LED is a semiconductor device which emits light when a forward voltage is applied thereto. Such an LED exhibits relatively longer lifespans, lower power consumption, and electrical, optical, and physical characteristics suitable for mass production.

However, LEDs generate relatively large amounts of heat. This heat may degrade performance of the lighting apparatus if such heat is not sufficiently dissipated through a heat sink, or the like. Moreover, if the heat generated from the LED is transferred to other constituent elements via the heat sink, the constituent elements may overheat or be damaged. The heat may also deform or otherwise damage the bulb if not sufficiently dissipated and allowed to transfer to the bulb.

Furthermore, LEDs may exhibit degraded light distribution characteristics because of a relatively narrow angular range of light emission, and hence, may not effectively illuminate a large area. For example, a lighting apparatus which employs LEDs may exhibit a high degree of directionality and a narrow radiation angle. For this reason, when an LED based lighting apparatus is installed on a ceiling, for example, only a relatively small region disposed directly beneath the lighting apparatus may be illuminated with sufficient intensity, and areas which are farther away from the light source may not be illuminated with sufficient intensity. Therefore, in order to illuminate a large area with a sufficient intensity of illumination, it may be necessary to increase the number of lighting apparatuses, at the expense of costs in materials and installation.

Accordingly, the present disclosure is directed to a lighting apparatus that substantially obviates one or more problems due to these limitations and disadvantages. As embodied and broadly described herein, a lighting apparatus may be capable of omni-directionally radiating light emitted from an LED while maintaining a uniform level of light intensity. The lighting apparatus may be capable of illuminating a wider area using light emitted from a light emitting diode (LED). The lighting apparatus may reduce the amount of heat transferred from a heat sink to a bulb. Moreover, the lighting apparatus as disclosed herein may allow a reduction in the number of constituent elements, a reduction in manufacturing costs, and be suitable for mass production.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

Reference will now be made in detail to embodiments of the present disclosure associated with a lighting apparatus, examples of which are illustrated in the accompanying drawings. The accompanying drawings illustrate embodiments of the present disclosure and provide a more detailed description of the present disclosure. However, the scope of the present disclosure should not be limited thereto.

In addition, wherever possible, the same reference numbers will be used throughout the drawings to refer to the same or like parts, and a repeated description thereof will be omitted. For clarity, dimensions and shapes of respective constituent members illustrated in the drawings may be exaggerated or reduced, and may not be to scale. Moreover, although terms including an ordinal number, such as first or second, may be used to describe a variety of constituent elements, the constituent elements are not limited to the terms, and the terms are used only for the purpose of discriminating one constituent element from other constituent elements.

Figure 2:
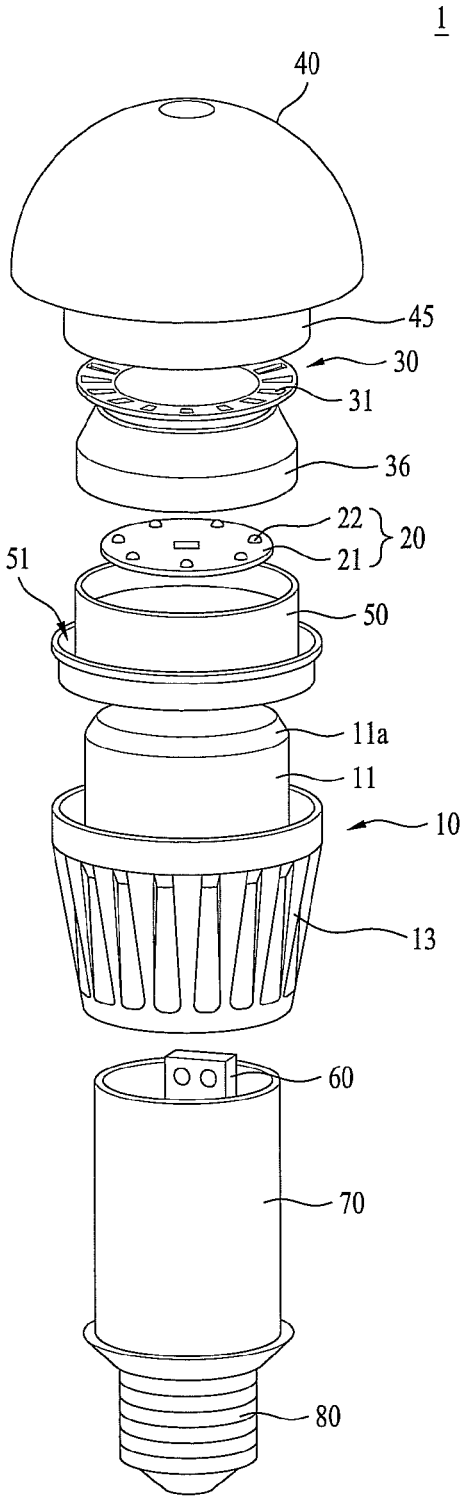
FIG. 2 is an exploded perspective view of the lighting apparatus.

FIG. 1 is a perspective view of a lighting apparatus according to an embodiment of the present disclosure. FIG. 2 is an exploded perspective view of the lighting apparatus of FIG. 1.

The lighting apparatus 1 may include a heat sink 10, a light emitting module 20 that includes a substrate 21 and light emitting diodes (LED) 22, and an enclosure 40 mounted to the heat sink 10 and surrounding the LEDs 22. The lighting apparatus 1 may also include a reflector 30 (reflection member) disposed within the enclosure 40 to reflect light emitted from the LEDs 22. The reflector 30 may include openings 31 to allow a portion of the light emitted from the LEDs 22 to pass therethrough. The lighting apparatus 1 may further include an electronic module 60 electrically connected to the light emitting module 20, a housing 70 that surrounds the electronic module 60 and which serves as the outer body of the lighting apparatus 1, and a power socket 80 mounted to the housing 70.

The enclosure 40 may have various shapes and sizes, taking into consideration the design of the lighting apparatus 1. For example, the enclosure 40 may be a bulb. The bulb 40 may have a function of diffusing light emitted from the light emitting module 20 or adjusting a direction light radiated outwardly from the bulb 40. For example, where the bulb 40 functions as a diffuser, it may scatter or diffuse light so that it may be possible to reduce or eliminate the directionality of light. In this case, the bulb 40 may also have a prescribed surface structure over the entire surface thereof (e.g., a patterned surface to scatter or diffuse light).

The electronic module 60 functions to convert external power (e.g., commercially available power) into input power that is compatible with the light emitting module 20. The electronic module 60 may include various elements, for example, a converter for converting AC power to DC power, and a transformer for adjusting the voltage level of the DC power. The electronic module 60 may be disposed within the housing 70. The housing 70 may provide thermal and/or electrical insulation between the heat sink 10 and electronic module 60. The power socket 80 may be mounted to the housing 70 to connect the lighting apparatus 1 to a power source.

Moreover, the housing 70 may be integrated with the heat sink 10. The housing 70 may be made of a metal material having high heat conduction properties to dissipate the heat generated by the light emitting module 20. Alternatively, the housing 70 may be configured separately from the heat sink 10. In this case, the housing 70 may be mounted to the heat sink 10. In particular, where the housing 70 and heat sink 10 are configured separately from each other, the housing 70 may be inserted into a cavity (insertion portion) provided at a lower end of the heat sink 10.

The heat sink 10 may be made of a metal material to rapidly dissipate heat generated from the light emitting module 20. A plurality of heat radiation fins 13 may be provided at the heat sink 10 to increase the contact surface of the heat sink 10 with ambient air. Moreover, the heat sink 10 may include a mounting portion 11 at an upper portion thereof on which the light emitting module 20 may be mounted. The mounting portion 11 may protrude upward to provide a raised mounting surface for the light emitting module (e.g., a raised platform. The mounting portion 11 may have a cylindrical shape, a hexagonal shape or another appropriate shape. The heat sink 10 may include an insertion space (cavity) at a lower region into which the housing 70 is inserted.

Meanwhile, as described above, the LED 22 of the light emitting module 20 may exhibit a high degree of directionality characterized by a narrow light distribution angle (e.g., about 120°). For this reason, when the LED 22 is disposed within the bulb 40 and aligned to emit light toward a central region 40*a* of the bulb 40, it may be difficult to illuminate a wide area (e.g., lower regions toward the socket end of the lighting apparatus 1). Hence, a reflector 30 may be provided to increase the illumination range.

Figure 3:
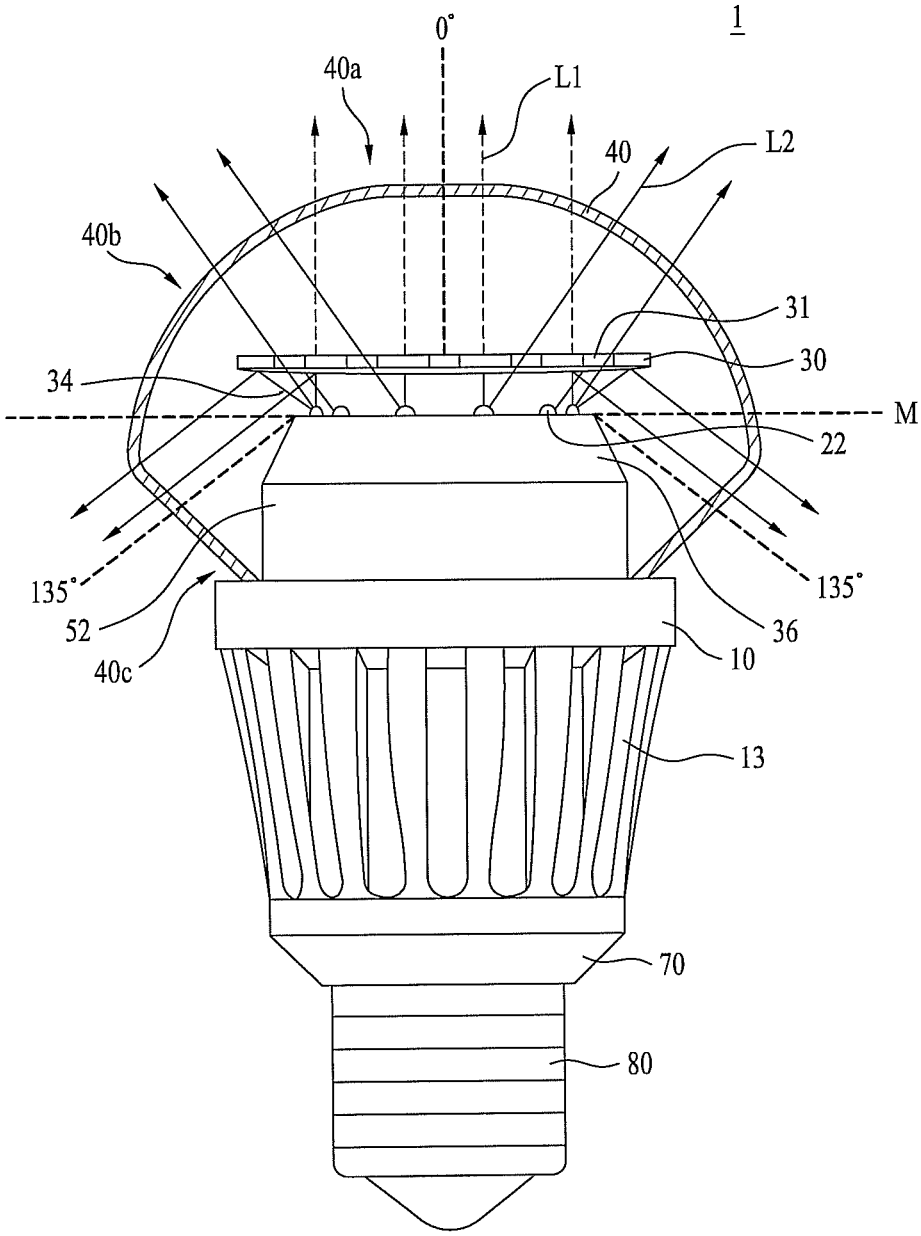
FIG. 3 is a side view illustrating an operational state of the lighting apparatus.
Figure 8:
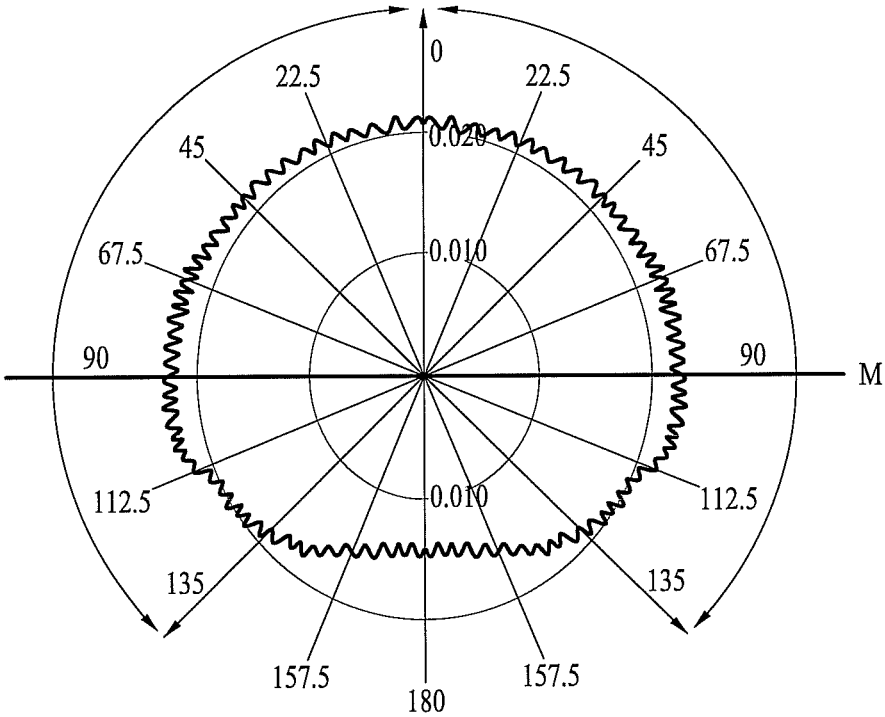
FIG. 8 is a graph illustrating illumination characteristics of the lighting apparatus.

FIG. 3 is a side view illustrating an operational state of the lighting apparatus. FIG. 8 is a graph illustrating light characteristics during operation of the lighting apparatus. The bulb 40 may be divided into a central region 40*a* at the upper region of the bulb 40, a side region 40*b* at the lateral side regions of the bulb 40, and a lower end region 40*c* arranged adjacent to the heat sink 10. The reflector 30 may reflect a portion of the light emitted from the LEDs 22 to the side region 40*b* and lower end region 40*c* of the bulb 40, while also allowing light to pass through the central region 40*a* of the bulb 40. Accordingly, the light from the LEDs 22 may be omni-directionally emitted from the bulb 40.

Omni-directional light distribution as referred to herein may include distribution of light having a minimum light velocity (luminous flux) of 5% or more of total flux at a light distribution angle of 135° or more, and having an average light velocity difference (luminous flux deviation) of 20% or less at a predetermined light distribution angle in a range of 0° to 135°.

In other words, luminous intensity (candelas) of the lighting apparatus 1 may be evenly distributed in a zone or angular range within 0° to 135°, measured from an optical center of the lighting apparatus (e.g., central vertical axis at 0°). This light distribution zone may be vertically axially symmetrical. At least 5% of total flux (lumens) may be emitted in the zone within 135° to 180°. Moreover, luminous intensity at any angle within the 0° to 135° zone may not differ from the mean luminous intensity for the entire zone by more than 20%. In the lighting apparatus 1, the reflector 30 may reflect light from the LEDs 22 toward the side and lower end region of the bulb 40 to produce the omni-directional light distribution. The reflector 30 may also include openings to allow a portion of light to ensure that a sufficient amount of light is entered through the central region 40*a* of the bulb. In FIGS. 3 and 8, reference character "M" is coplanar to the mounting surface on which the light emitting module 20 is arranged.

The reflector 30 may reflect light emitted from the LEDs 22 at a first light distribution path $L_1$ while allowing light emitted from the LEDs 22 at a second light distribution path $L_2$ to pass through the openings 31. Here, the angle of path $L_2$ may be greater than an angle of path $L_1$ with respect to the light axis (i.e., 0°).

The light emitted from the LEDs 22 within the first light distribution path $L_1$ may be radiated through the side and lower end regions via the reflector 30 because the amount thereof is large. On the other hand, the light emitted from the LEDs 22 within the second light distribution path $L_2$ may be radiated directly outwardly of the bulb 40 through the openings 31 of the reflector 30 because the amount thereof is relatively smaller.

Figure 4:
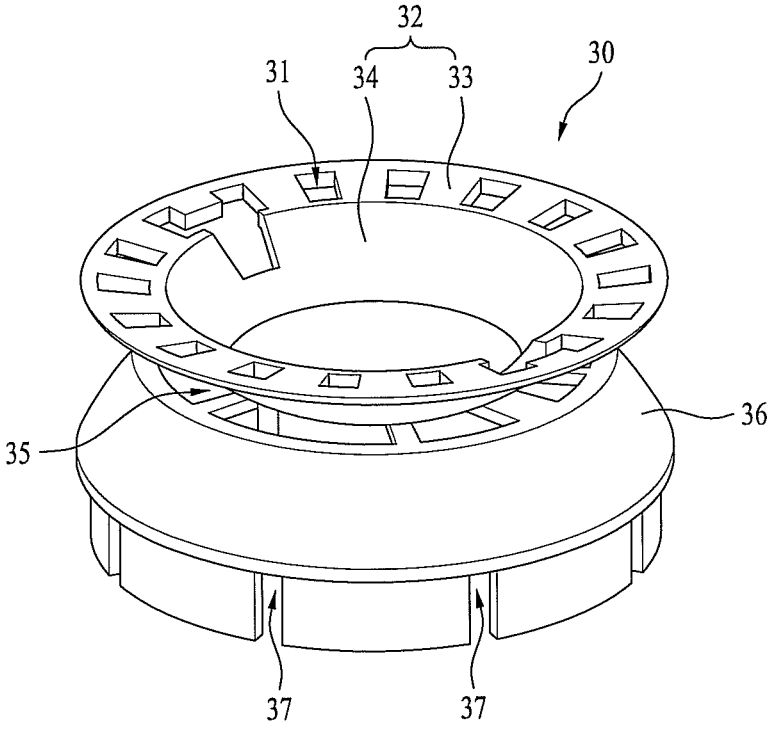
FIG. 4 is a perspective view of a reflector for the lighting apparatus.
Figure 5:
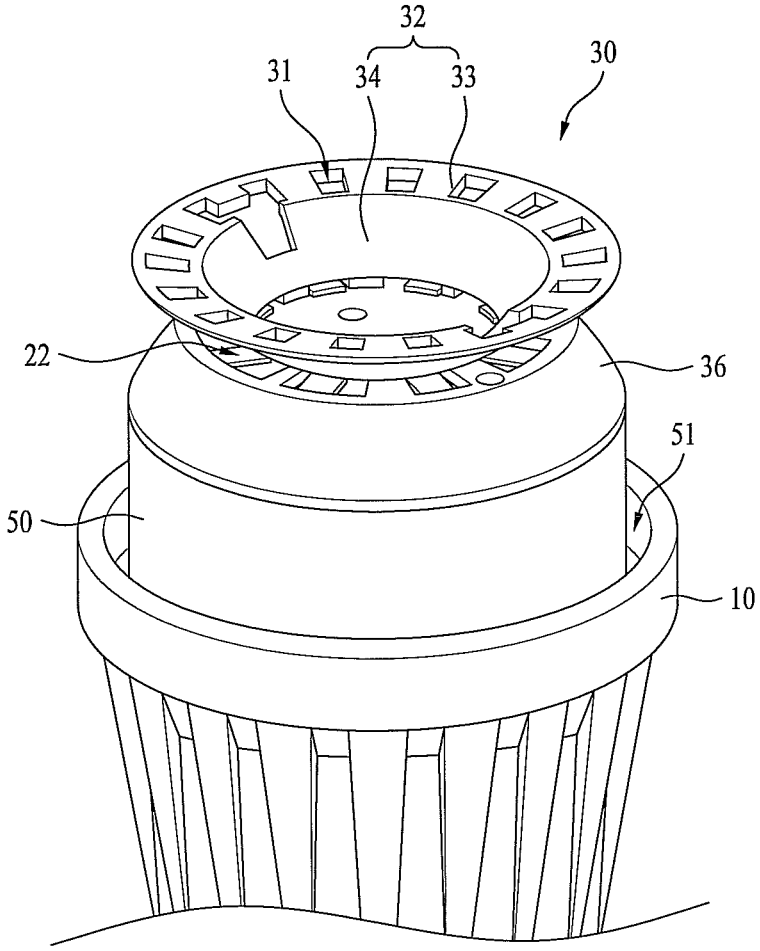
FIG. 5 is a perspective view of the reflector mounted on the lighting apparatus.

FIG. 4 is a perspective view of a reflector for the lighting apparatus and FIG. 5 is a perspective view of the reflector mounted on the lighting apparatus. The reflector 30 may include a reflection section 32, which includes a first reflection portion 33 arranged over the light emitting module 20 while being upwardly spaced apart from the light emitting module 20 by a certain distance, and a second reflection portion 34 that extends from the first reflection portion 33 toward the substrate 21. The openings 31 may be provided at the first reflection portion 33.

The first reflection portion 33 may be arranged to be substantially parallel with the substrate 21 of the light emitting module 20. The first reflection portion 33 may also be angled relative to the substrate based on the desired angle of light emission. Moreover, the upper surface of the reflective portion 33 may be parallel to the substrate while the lower surface of the reflective portion 33 facing the LEDs may be angled relative to the substrate.

The first reflection portion 33 may have a ring shape. The second reflection portion 34 may extend from an inner end of the first reflection portion 33 while having an inclined surface having a prescribed inclination with respect to the substrate 21. The second reflection portion 34 may have a hollow cylindrical shape. For example, the second reflection portion 34 may have a cross section that gradually decreases in width as the second reflection portion 34 extends toward the light emitting module 20.

A plurality of LEDs 22 may be radially arranged on the substrate 21 of the light emitting module 20. The openings 31 may be radially arranged at the first reflection portion 33 and spaced apart from each other at predetermined distances. The distances between the openings 31 may be the same or may be different based on the desired light emission characteristics. Moreover, the sizes of the openings 31 may be varied to increase or decrease the amount of light emitted through the openings 31.

In one embodiment, the first reflection portion 33 may be formed of a translucent material to partially emit light from the LEDs 22. Moreover, a reflective material may be placed on the reflector 30. For example, a reflective film having openings may be placed on a reflector 30 that is made of a transparent or translucent material. Accordingly, the reflective material may replace the openings formed on the reflector 30. The material may be a reflective sheet, film, coating, or the like. It should be appreciated that a non-reflective material may be placed on a reflector 30 made of a reflective material to achieve a similar result.

The LEDs 22 may be arranged in a space between the first reflection portion 33 and the second reflection portion 34. Light emitted from the LEDs 22 may be reflected by at least one of the first and second reflection portions 33 and 34, toward the side region or lower end region of the bulb 40 or it may be allowed to pass through the reflector at the openings 31 toward the central region of the bulb 40.

The reflector 30 may further include a third reflection portion 36 that surrounds the mounting portion 11 of the heat sink 10 and a portion of the substrate 21. The third reflection portion 36 may function as a base for the reflector 30 as well as a reflective cover for the mounting portion 11. The third reflection portion 36 may have a smaller diameter than the first reflection portion 33, as shown in FIG. 1. Alternatively, the size of the third reflection portion 36 may be wider than the diameter of the first reflection portion 33. In this case, the effect of the third reflection portion 36 is increased to direct more light toward the side and top regions of the lighting apparatus 1 (e.g., through regions 40*a* and 40*b*).

The third reflection portion 36 may have through holes 35, through which the LEDs 22 are exposed. Since the substrate 21 is disposed inside the reflector 30 under the condition that only the LEDs 22 are outwardly exposed through the through holes 35, light emitted from the LEDs 22 may be reflected by the reflector 30 without being absorbed by the substrate 21. Accordingly, an enhancement in light efficiency may be achieved.

A plurality of slits 37 may be formed at a region corresponding to the top portion of the heat sink 10, namely, the mounting portion 11. The slits 37 may fit into corresponding protrusions on the heat sink 10 to facilitate alignment of the reflector 30. The slits 37 may be positioned at different distances with respect to each other. Here, the reflector 30 may be keyed using the slits 37 to control the orientation of the reflector, e.g., the relative position of the LEDs 22 to the openings 31, as described in further detail hereinafter. The plurality of slits 37 may improve efficiency in mounting the reflector 30 to the heat sink 10 during assembly.

The third reflection portion 36 may be integrated with the second reflection portion 34. In this case, the assembly process may be simplified by arranging the light emitting module 20 on the mounting portion 11 of the heat sink 11, and fitting the reflector 30 in the heat sink 10 such that the LEDs 22 are exposed.

The mounting portion 11, which is formed at the top portion of the heat sink 10 and on which the substrate 21 is mounted, may be upwardly protruded from a lower end of the bulb 40 by a prescribed distance to form a raised platform. Where the mounting portion 11 of the heat sink 10 is upwardly protruded from the lower end of the bulb 40 by a predetermined distance, the LEDs 22 are also raised from the lower end of the bulb 40. Accordingly, the effective illumination area through the lower end region 40*c* of the bulb 40 may be increased to improve the backward light distribution characteristics of the lighting apparatus 1.

Meanwhile, the mounting portion 11 of the heat sink 10 may have an inclined surface 11*a* at a circumferential region thereof (FIG. 2). The third reflection portion 36 may have an inclined surface that corresponds to the inclined surface 11*a* of the mounting portion 11. In accordance with these structures, it may be possible to prevent the mounting portion 11 of the heat sink 10 from interfering with light emitted from the LEDs 22 reflected by the reflector 30.

Referring again to FIG. 2, the lighting apparatus 1 may additionally include an insulating cap 50 arranged between the heat sink 10 and the bulb 40. As described above, the heat sink 10 may dissipate heat generated by the light emitting module 20. Accordingly, the temperature of the heat sink 10 may increase during operation of the lighting apparatus 1.

Where the bulb 40 is directly mounted to the heat sink 10, the heat from the heat sink 10 may be directly transferred to the bulb 40. To this end, the insulating cap 50 is provided as a heat insulator to reduce heat transfer from the heat sink 10 to the bulb 40.

The insulating cap 50 may include a hollow body, and a fitting groove 51 formed at an outer circumferential surface of the body. The body may be mounted to the heat sink 10 and the mounting flange 45 of the bulb 40 may be placed inside the fitting groove 51.

In one embodiment, the insulating cap 51 may be integrated in the third reflection portion 36. Here, the bottom portion of the third reflection portion 36 may include the fitting groove 51. Heat insulating material may be placed inside the fitting groove 51 to reduce heat transfer to the bulb 40.

Figure 6:
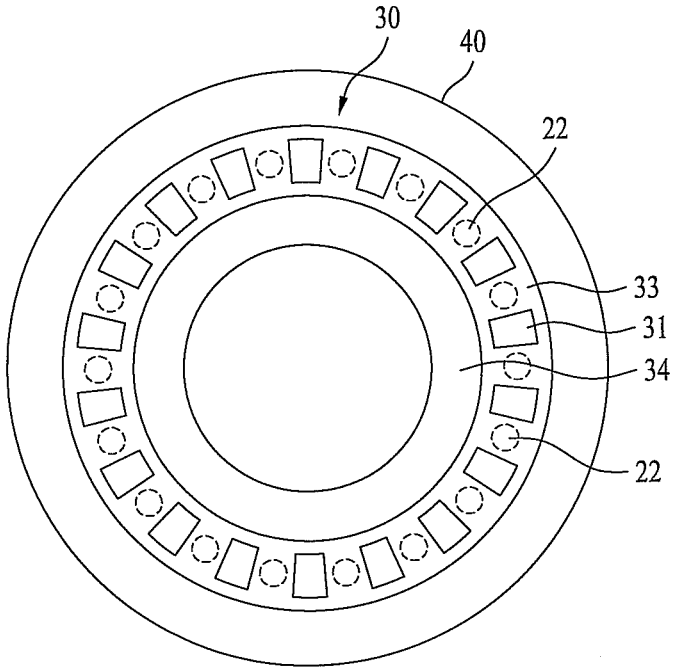
FIG. 6 is a plan view of a reflector according to one embodiment.

FIG. 6 is a plan view of a reflector according to one embodiment. Each of the openings of the reflector 30 may be formed to have a center that is eccentric from a light emission axis of each corresponding LED 22. That is, each opening may be positioned to not spatially overlap the LEDs. Hence, a portion of light emitted from the LEDs 22 at an angle may be radiated directly outward from the bulb 40 through the openings 31, while light emitted directly toward the top region 40*a* may be reflected toward the heat sink 10. In this structure, it may be possible to prevent an occurrence of a glare phenomenon because the reflector 30 reflects a portion of light being emitted.

Moreover, the group of openings 31 and the group of LEDs may be arranged radially. The radially arranged group of openings 31 may be concentric to the radially arranged group of LEDs 22. The radius of the openings 31 and the LEDs 22 may be the same, such that the LEDs 22 are positioned between two openings 31 as shown in FIG. 6. Alternatively, the LEDs 22 may be positioned closer toward the central axis, e.g., to be positioned spatially under the second reflection portion 34, based on the desired amount of reflectivity.

In one embodiment, the third reflection portion may be rotatably attached to the second reflection portion 34. Here, it is possible to adjust the relative positions of the openings 31 to the respective LEDs 22 to either increase or decrease the amount of light emitted through the upper region 40*a* of the bulb 40.

In one embodiment, the slits 37 may be provided to control the position of the openings 31 relative to the LEDs 22. For example, based on the position of the slits 37, the reflector may be keyed to specific positions on the heat sink 10. Hence, the orientation of the reflector 30 may be controlled to position the openings 31 spatially over the LEDs 22 or spatially offset relative to the LEDs 22.

Figure 7:
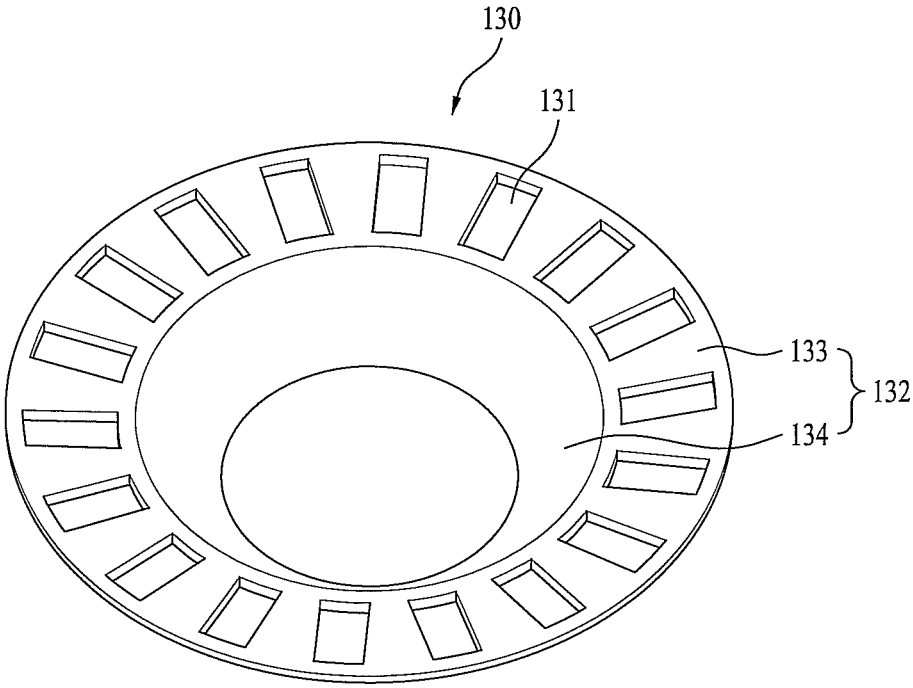
FIG. 7 is a perspective view of a reflector for the lighting apparatus according to an embodiment of the present disclosure.

FIG. 7 is a perspective view of a reflector in accordance with another embodiment of the present disclosure. While the reflector 30 may be configured to surround both the light emitting module 210 and the mounting portion 11 of the heat sink 11, as previously described, the reflector 130 may be configured to surround only the light emitting module 20. The reflector may be mounted directly on the surface of the substrate 21.

The reflector 130 may include a reflection section 132, which includes a first reflection portion 133 arranged over the light emitting module 20 while being upwardly spaced apart from the light emitting module 20 by a certain distance, and a second reflection portion 134 extending from the first reflection portion 133 toward the substrate 21. Openings 131, which correspond to the openings 31, may be provided at the first reflection portion 133.

The first reflection portion 133 may be arranged to be substantially parallel with the substrate 21 of the light emitting module 20 or angled at a prescribed angle relative to the substrate 21. The first reflection portion 133 may have a ring shape. The second reflection portion 134 may extend from an inner end of the first reflection portion 133 while having an inclined surface having a certain inclination with respect to the substrate 21. The second reflection portion 134 may have a hollow cylindrical or conical shape. In particular, the second reflection portion 134 may have a cross section that gradually decreases in width as the second reflection portion 134 extends toward the light emitting module 20.

A plurality of LEDs 22 may be radially arranged on the substrate 21 of the light emitting module 20. The openings 131 may be radially arranged at the first reflection portion 133. In this case, the LEDs 22 may be arranged in a space between the first reflection portion 133 and the second reflection portion 134. Light emitted from the LEDs 22 may be reflected by at least one of the first and second reflection portions 133 and 134, and then reflected toward the side region or lower end region of the bulb 40 or it may be radiated from the central region of the bulb 40 through the openings 131.

As apparent from the above description, the lighting apparatus as broadly described and embodied herein may omnidirectionally radiate light emitted from the LEDs. Also, the lighting apparatus may illuminate a wider region at a uniform intensity. In addition, the lighting apparatus may achieve a reduction in the number of constituent elements, a reduction in manufacturing costs, and ease of mass production.

To achieve these objects and other advantages and in accordance with the purpose of the disclosure, as embodied and broadly described herein, a lighting apparatus may include a housing, a light emitting module provided on the housing and including a substrate and at least one light emitting diode (LED) mounted on the substrate, a reflector to reflect light emitted from the at least one LED, an enclosure provided over the housing to surround the light emitting module and the reflector, and a power socket mounted to the housing and electrically connected to the light emitting module. The reflector may have a surface positioned a prescribed height over the LED and angled to face the light emitting module at a prescribed angle, and at least one opening provided on the surface to correspond to the at least one LED. The LED may emit light in a first direction and the reflector reflects the light in a second direction such that a difference in light intensity at any angle within a first range between 0° to 135° with respect to the first direction is less than or equal 20% of an average light intensity of the entire range, and a light flux within a second range between 135° to 180° is greater than or equal to 5% of the total flux.

Each opening on the reflector may be arranged to have a central axis that is eccentric to a light emission axis of a corresponding LED. The reflector may be positioned to reflect light emitted from the LED at a first light distribution angle and the opening on the reflector may be positioned to allow light emitted at a second light distribution angle to pass through, wherein the second light distribution angle is greater than the first light distribution angle relative to a light emission axis of the LED. The reflector may have a second surface that extends from the first surface to the substrate, and the second surface may be inclined at a second prescribed angle that is less than the prescribed angle of the first surface with respect to the light emission axis.

The first surface may be arranged to be substantially parallel to the substrate of the light emitting module. The first surface may have a ring shape, wherein the second surface extends from an inner end of the first surface to the substrate. A plurality of LEDs may be positioned radially on the substrate of the light emitting module, and the openings are positioned radially on the first surface.

The lighting apparatus may further include a heat sink, wherein the reflector includes a third surface that substantially covers an upper portion of the heat sink and the substrate. The third surface may have at least one opening that correspond to a position of the at least one LED such that the at least one LED is exposed through the opening. The third surface may be provided with a plurality of slits formed at a region corresponding to the upper portion of the heat sink. Moreover, the third surface may be integrated with the second surface.

A protrusion may be formed at the upper portion of the heat sink for mounting the substrate, and the protrusion may extend a predetermined height above a lower end of the bulb. An upper region of the protrusion may have an inclined surface that inclines downward at a prescribed angle. The third surface of the reflector may have an inclined surface that corresponds to the inclined surface of the protrusion.

In one embodiment, a lighting apparatus may have a housing, a light emitting module provided on the housing and including a substrate and at least one light emitting diode (LED) mounted on the substrate, a reflector to reflect light emitted from the at least one LED, an enclosure provided over the housing to surround the light emitting module and the reflector, and a power socket mounted to the housing and electrically connected to the light emitting module. The reflector may have a first surface that extends from the substrate and a second surface that extends from the first surface at a prescribed height over the LED, the first and second surfaces angled to face the light emitting module at prescribed angles, and an opening on the second surface to correspond to the at least one LED. The LED may emit light in a first direction and the reflector reflects the light in a second direction.

In this embodiment, the first direction may be inclined relative to the substrate and the second direction is declined relative to the substrate. Each opening on the reflector may be arranged to have a central axis that is eccentric to a light emission axis of a corresponding LED. The first surface may have a ring shape, and the second surface may extend from an inner circumferential end of the first surface to the substrate.

A plurality of LEDs may be arranged radially on the substrate of the light emitting module, and the openings may be arranged radially on the first surface of the reflector. The plurality of LEDs are concentric to the plurality of openings. Moreover, each of the plurality of openings may be configured to not spatially overlap the plurality of LEDs.

As broadly described and embodied herein, a lighting apparatus may include a housing for defining an outer appearance of the lighting apparatus, a light emitting module including a substrate, and at least one light emitting diode (LED) mounted on the substrate, a bulb arranged to surround the LED, a power socket mounted to the housing and electrically connected to the light emitting module, and a reflection member disposed within the bulb to backwardly reflect light forwardly emitted from the LED such that the light has a light intensity exhibiting a difference of 20% or less from an average light intensity at a light distribution angle ranging from 0° to 135° in a forward direction while having a light flux corresponding to 5% or more of a total light flux at a light distribution angle ranging from 135° to 180°, the reflection member including openings for allowing a part of the light emitted from the to forwardly pass through the reflection member.

The openings of the reflection member may be arranged to have a central axis eccentric from a light emission axis of the LED. The reflection member may reflect light emitted from the LED at a first light distribution angle while allowing light emitted from the LED at a second light distribution angle greater than the first light distribution angle to pass through the openings.

The reflection member may include a first reflection portion arranged over the light emitting module in an upward direction corresponding to the forward light emission direction of the light emitting module while being upwardly spaced apart from the light emitting module by a predetermined distance, and a second reflection portion extending from the first reflection portion toward the substrate. The openings may be provided at the first reflection portion. The first reflection portion may be arranged to be substantially parallel with the substrate of the light emitting module.

The first reflection portion may have a ring shape. The second reflection portion may extend from an inner end of the first reflection portion while having an inclined surface having a certain inclination with respect to the substrate. The at least one LED may include a plurality of LEDs radially arranged on the substrate of the light emitting module. The openings may be radially provided at the first reflection portion.

The lighting apparatus may further include a heat sink. The reflection member may further include a third reflection portion surrounding a top portion of the heat sink and a portion of the substrate. The third reflection portion may have through holes, through which the LED is exposed. The third reflection portion may be provided with a plurality of slits formed at a region corresponding to the top portion of the heat sink. The third reflection portion may be integrated with the second reflection portion.

The heat sink may be provided, at the top portion thereof, with a mounting portion, on which the substrate is mounted. The mounting portion may be upwardly protruded from a lower end of the bulb by a predetermined distance. The mounting portion of the heat sink may be formed with an inclined surface at a circumferential region thereof. The third reflection portion may be formed with an inclined surface at a region thereof corresponding to the circumferential region of the mounting portion.

The lighting apparatus may further include an insulating cap interposed between the heat sink and the bulb. The insulating cap may include a hollow body, and a fitting groove formed at an outer circumferential surface of the body. The body may be mounted to the heat sink. The bulb may be fitted, at the lower end thereof, in the fitting groove.

In another aspect of the present disclosure, a lighting apparatus may include a heat sink, a light emitting module including a substrate disposed on the heat sink, and at least one light emitting diode (LED) mounted on the substrate, a bulb arranged to surround the LED, a housing for defining an outer appearance of the lighting apparatus, the housing including an electronic module electrically connected to the light emitting module, a power socket mounted to the housing and electrically connected to the electronic module, and a reflection member disposed within the bulb to backwardly reflect light emitted from the LED, the reflection member including openings for allowing a part of the light emitted from the to forwardly pass through the reflection member.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a housing;

a light emitting module provided on the housing and including a substrate and at least one light emitting diode (LED) mounted on the substrate;

a reflector to reflect light emitted from the at least one LED;

an enclosure provided over the housing to surround the light emitting module and the reflector; and a power socket mounted to the housing and electrically connected to the light emitting module, wherein the reflector has a first surface positioned a prescribed height over the LED and angled to face the light emitting module at a prescribed angle, and at least one opening provided on the first surface to correspond to the at least one LED, and wherein the reflector has a second surface that extends from the first surface to the substrate, and wherein the second surface is inclined at a second prescribed angle that is less than the prescribed angle of the first surface with respect to the light emission axis.

2. The lighting apparatus of claim 1, wherein each opening on the reflector is arranged to have a central axis that is eccentric to a light emission axis of a corresponding LED.

3. The lighting apparatus of claim 1, wherein the reflector is positioned to reflect light emitted from the LED at a first light distribution angle and the opening on the reflector is positioned to allow light emitted at a second light distribution angle to pass through, wherein the second light distribution angle is greater than the first light distribution angle relative to a light emission axis of the LED.

4. The lighting apparatus of claim 1, wherein the first surface is arranged to be substantially parallel to the substrate of the light emitting module.

5. The lighting apparatus of claim 1, wherein the first surface has a ring shape, and wherein the second surface extends from an inner end of the first surface to the substrate.

6. The lighting apparatus of claim 1, wherein a plurality of LEDs are positioned radially on the substrate of the light emitting module, and the openings are positioned radially on the first surface.

7. The lighting apparatus of claim 1, further including a heat sink, wherein the reflector includes a third surface that substantially covers an upper portion of the heat sink and the substrate.

8. The lighting apparatus of claim 7, wherein the third surface has at least one opening that correspond to a position of the at least one LED such that the at least one LED is exposed through the opening.

9. The lighting apparatus of claim 7, wherein the third surface is provided with a plurality of slits formed at a region corresponding to the upper portion of the heat sink.

10. The lighting apparatus of claim 7, wherein the third surface is integrated with the second surface.

11. The lighting apparatus of claim 7, wherein a protrusion is formed at the upper portion of the heat sink for mounting the substrate, and wherein the protrusion extends a predetermined height above a lower end of the enclosure.

12. The lighting apparatus of claim 11, wherein an upper region of the protrusion has an inclined surface that inclines downward at a prescribed angle.

13. The lighting apparatus of claim 12, wherein the third surface of the reflector has an inclined surface that corresponds to the inclined surface of the protrusion.

14. A lighting apparatus comprising:

a housing;

a light emitting module provided on the housing and including a substrate and at least one light emitting diode (LED) mounted on the substrate;

a reflector to reflect light emitted from the at least one LED;

an enclosure provided over the housing to surround the light emitting module and the reflector; and a power socket mounted to the housing and electrically connected to the light emitting module, wherein the reflector has a first surface that extends from the substrate and a second surface that extends from the first surface at a prescribed height over the LED, the first and second surfaces angled to face the light emitting module at prescribed angles, and an opening on the second surface to correspond to the at least one LED, and wherein the LED emits light in a first direction and the reflector reflects the light in a second direction.

15. The lighting apparatus of claim 14, wherein the first direction is inclined relative to the substrate and the second direction is declined relative to the substrate.

16. The lighting apparatus of claim 14, wherein each opening on the reflector is arranged to have a central axis that is eccentric to a light emission axis of a corresponding LED.

17. The lighting apparatus of claim 14, wherein the first surface has a ring shape, and the second surface extends from an inner circumferential end of the first surface to the substrate.

18. The lighting apparatus of claim 17, wherein a plurality of LEDs are arranged radially on the substrate of the light emitting module, and the openings are arranged radially on the first surface of the reflector, and wherein the plurality of LEDs are concentric to the plurality of openings.

19. The lighting apparatus of claim 18, wherein each of the plurality of openings do not spatially overlap the plurality of LEDs.

* * * * *